US007264657B2

(12) United States Patent
Yuen

(10) Patent No.: US 7,264,657 B2
(45) **Date of Patent: *Sep. 4, 2007**

(54) PHOTO-ELECTRONIC AIR CONDITIONING, DEHUMIDIFYING, PURIFYING AND DISINFECTING SYSTEM

(75) Inventor: John Se-Kit Yuen, Kowloon (HK)

(73) Assignee: John Manufacturing Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 11/157,953

(22) Filed: Jun. 22, 2005

(65) Prior Publication Data

US 2006/0005707 A1 Jan. 12, 2006

(30) Foreign Application Priority Data

Jun. 23, 2004 (HK) ..... 04104500

(51) Int. Cl.
*B03C 3/016* (2006.01)

(52) U.S. Cl. ..... 96/16; 96/224; 422/121

(58) Field of Classification Search ..... 96/16, 96/224; 422/24, 121, 186.04, 186.3
See application file for complete search history.

(56) References Cited

U.S. PATENT DOCUMENTS

| | | | | |
|---|---|---|---|---|
| 2,638,644 | A * | 5/1953 | Rauhut | 96/142 |
| 3,750,370 | A * | 8/1973 | Brauss et al. | 96/140 |
| 3,798,879 | A * | 3/1974 | Schmidt-Burbach et al. | 96/16 |
| 4,203,948 | A * | 5/1980 | Brundbjerg | 422/121 |
| 5,240,478 | A * | 8/1993 | Messina | 95/273 |
| 5,616,172 | A * | 4/1997 | Tuckerman et al. | 96/16 |
| 5,632,806 | A * | 5/1997 | Galassi | 96/16 |
| 5,681,374 | A * | 10/1997 | Von Glehn | 96/16 |
| 5,997,619 | A * | 12/1999 | Knuth et al. | 96/224 |
| 6,149,717 | A * | 11/2000 | Satyapal et al. | 96/16 |
| 6,464,760 | B1 * | 10/2002 | Sham et al. | 96/117.5 |
| 6,497,840 | B1 * | 12/2002 | Palestro et al. | 422/24 |
| 2002/0121196 | A1 * | 9/2002 | Thakur et al. | 96/224 |

FOREIGN PATENT DOCUMENTS

| | | | | |
|---|---|---|---|---|
| GB | 2036951 | * | 7/1980 | 96/16 |
| GB | 2372947 | A | 9/2002 | |
| WO | WO 2005/039659 | A1 | 5/2005 | |

* cited by examiner

*Primary Examiner*—Richard L. Chiesa
(74) *Attorney, Agent, or Firm*—Mattingly, Stanger, Malur & Brundidge, PC

(57) ABSTRACT

A 4-in-1 photo-electronic air conditioning, dehumidifying, purifying and disinfecting system has an activated carbon filter in the first stage to eliminate impurities, germs and bacteria in the air drawn into the system. The bacteria and germs in the extracted air, which are capable of passing through the activated carbon filter, are then eliminated by extreme-UV light emitted by extreme-UV light tubes. The excessive moisture in the air is also removed. A negative ion generator is also used to boost the level of anions in the air. These two modes operate in the following manner: the first mode involves high-voltage cathodic output that is discharged via a carbonized fibre. The ionised air is then expelled by an air drum. The second mode eliminates bacteria, germs and mould from air as it passes extreme-UV light tubes by exposure to extreme-UV light emitted by these extreme-UV light tubes.

10 Claims, 9 Drawing Sheets

PHOTO-ELECTRONIC AIR CONDITIONING, DEHUMIDIFYING, PURIFYING AND DISINFECTING SYSTEM

This invention relates to a photo-electronic air conditioning, dehumidifying, purifying and disinfecting system, powered by the mains supply.

The aim of this invention is to present a new design for a 4-in-1 photo-electronic air conditioning, dehumidifying, purifying and disinfecting system.

According to an aspect of the present invention, there is provided a photo-electronic air conditioning, dehumidifying, purifying and disinfecting system comprising a housing containing an air drum, an electric motor, one or more extreme-UV light tubes, one or more air-arresting units, a power supply cable, a cathodic high-voltage carbonized fibre and an activated carbon filter.

In a preferred embodiment of the system, the air arresting unit concentrates or deflects the airflow into slot(s) containing the extreme-UV light tube(s). This brings the air into close proximity to the extreme-UV light tube(s) for treatment.

An activated carbon filter is used in the first stage to eliminate impurities, germs and bacteria in the air drawn into the system. The bacteria and germs, which are capable of passing through the activated carbon filter, are then eliminated by extreme-UV light emitted by extreme-UV light tube(s). The excessive moisture in the air is also removed. The system is capable of eliminating the bacteria, germs, and mould contained in the air as it passes the extreme-UV light tubes. It also utilises a negative ion generator to boost the level of anions in the air. First and second modes operate in the following manner: the first mode involves high-voltage cathodic output that is discharged via a carbonized fibre. The ionised air is then expelled by an air drum. The second mode eliminates bacteria, germs and mould from air as it passes extreme-UV light tubes by exposure to extreme-UV light emitted by these extreme-UV light tubes. This allows the user to make a variety of choices based on the two modes of operation, including individual operation in either mode one or mode two, or in continuous simultaneous operation or in alternating cycle operation of the two modes.

The system comprises the following major parts: an activated carbon filter, an air drum, extreme-UV light tube(s) and a cathodic high-voltage fibre. When air enters the 4-in-1 photo-electronic air conditioning, dehumidifying, purifying and disinfecting system via the air drum, the airborne impurities, germs and bacteria are filtered out via an activated carbon filter. Then the system enters two continuous alternating mode cycles: the first involves high voltage cathodic output discharged via a carbonized fibre which ionizes the air which is then expelled by an air drum; the second involves turning on extreme-UV light tubes which emit extreme-UV light eliminating airborne bacteria, germs and mould as they pass the tubes. There are an air inlet and an air outlet on the top of the system. A cathodic high-voltage carbonized fibre is secured to the air outlet, while an extreme-UV light tube is mounted near the air outlet inside the housing. The air drum, located directly below the air outlet, sucks air through the air intake grille unit into the system. It then streams through the activated carbon filter prior to exposure to and sterilization of germs, bacteria and mould by extreme-UV light emitted by the extreme-UV light tubes. The air is ionised before being discharged through the air outlet as clean, fresh air, thereby enhancing air quality indoors.

The system is housed in a case in the form of a square column.

A preferred non-limiting embodiment of the present invention will now be described with reference to the accompanying diagrammatic drawings, in which:—

Figure 1:
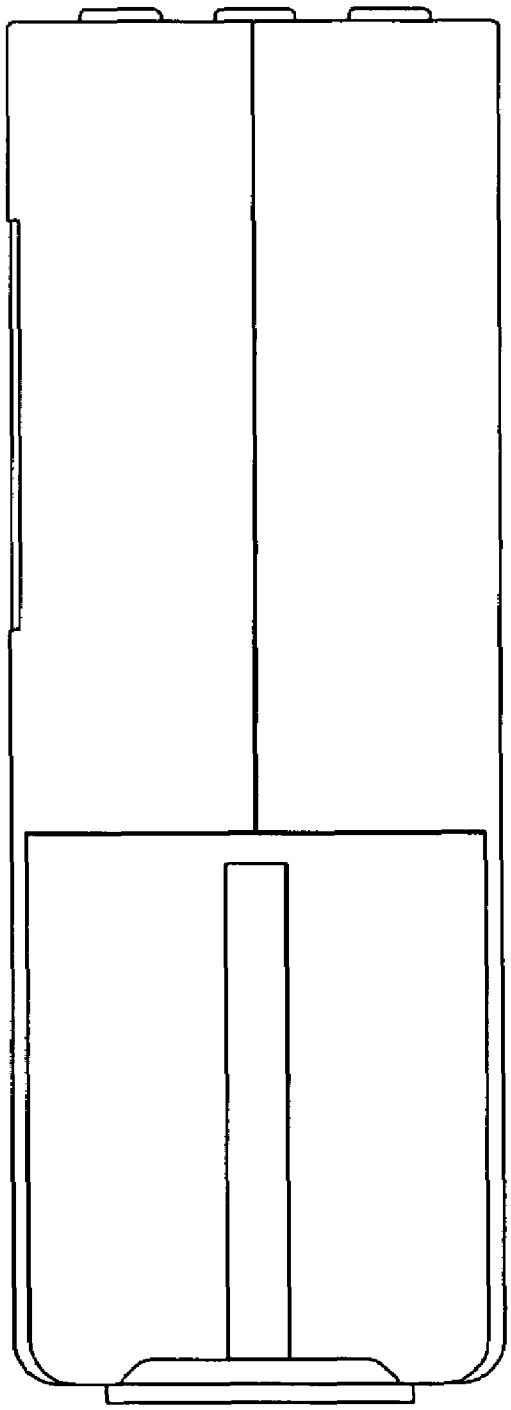
FIG. 1 is a side elevation view of a photo-electronic air conditioning, dehumidifying, purifying and disinfecting system in accordance with a preferred embodiment of the present invention.
Figure 2:
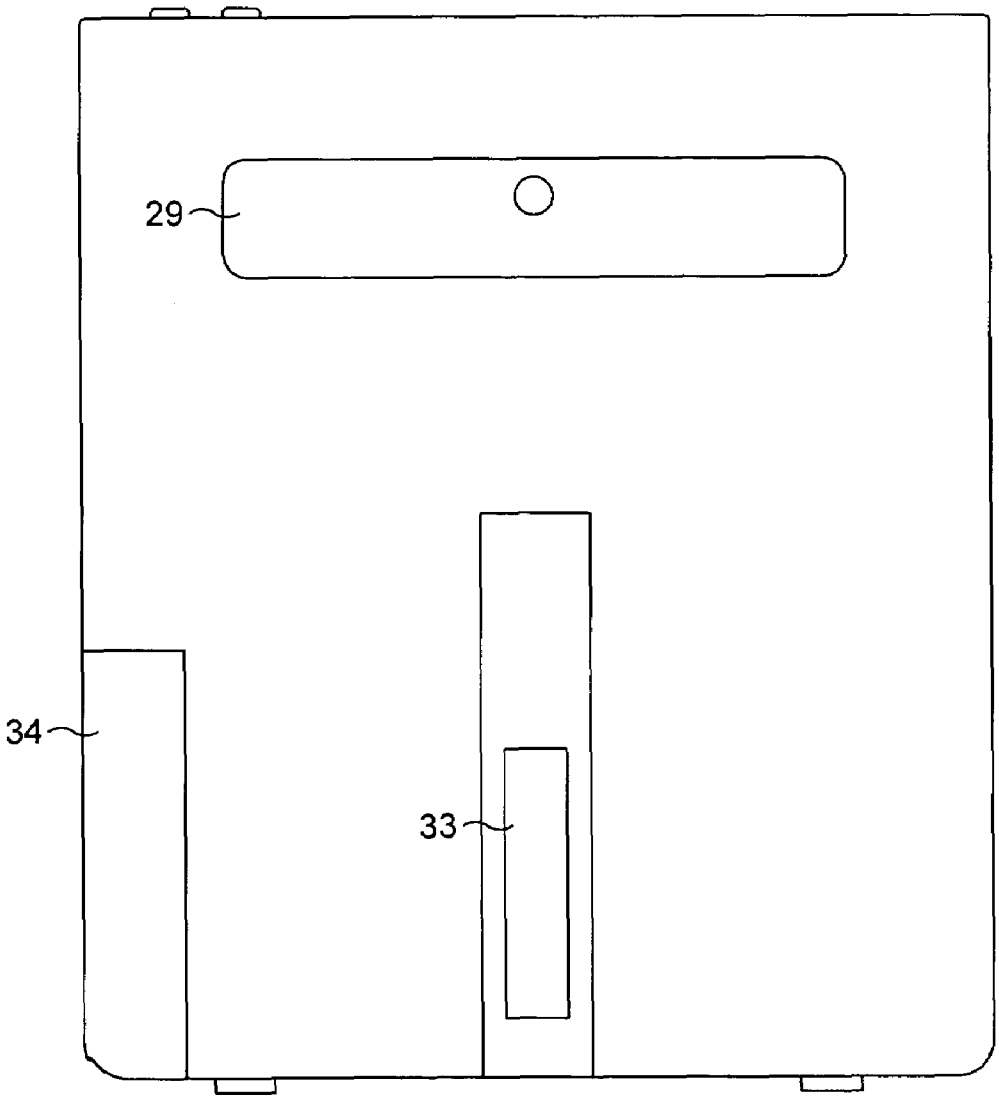
FIG. 2 is a plan view of the product depicted in FIG. 1.
Figure 3:
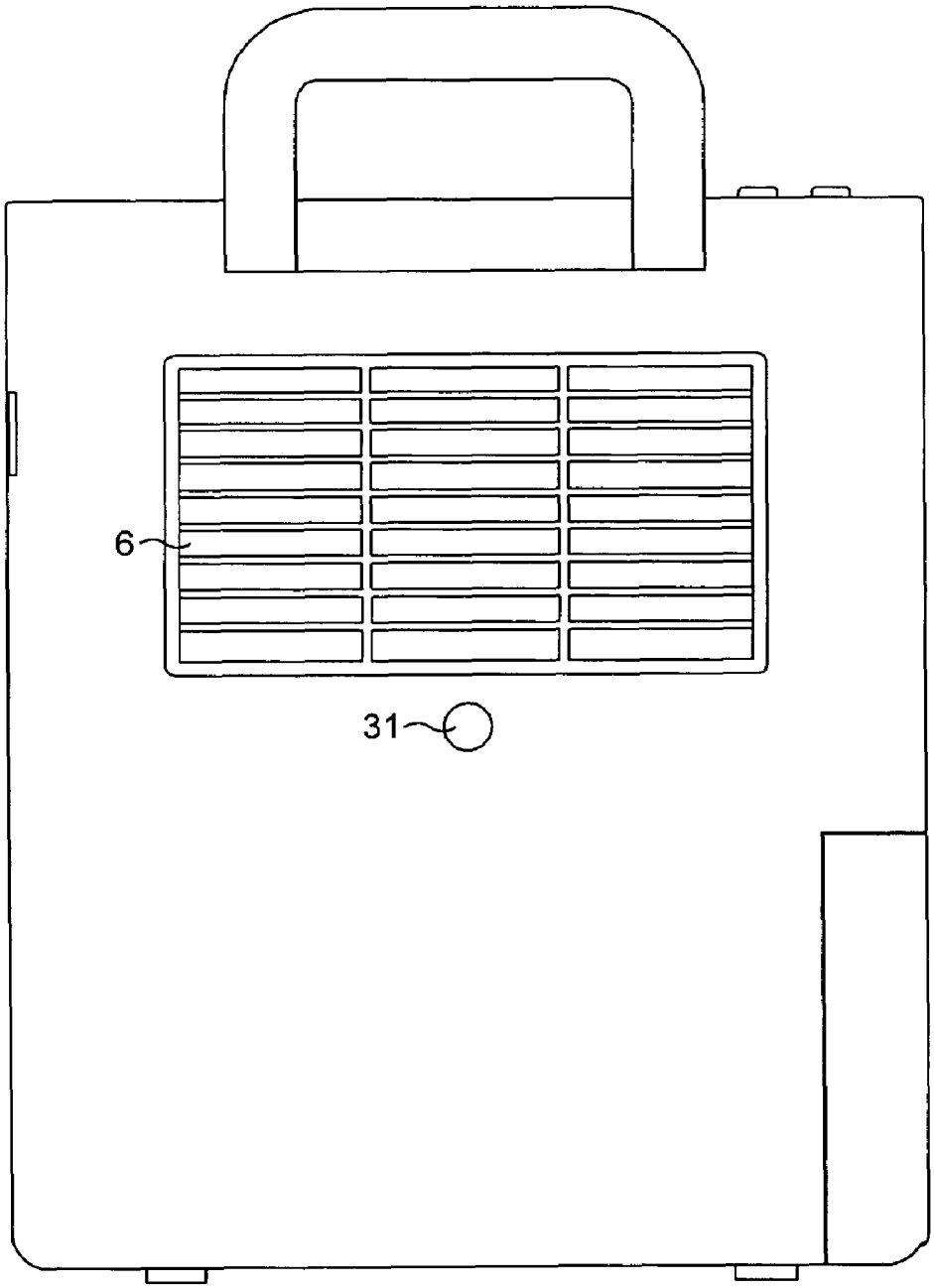
FIG. 3 is a rear view of the product depicted in FIG. 1.
Figure 4:
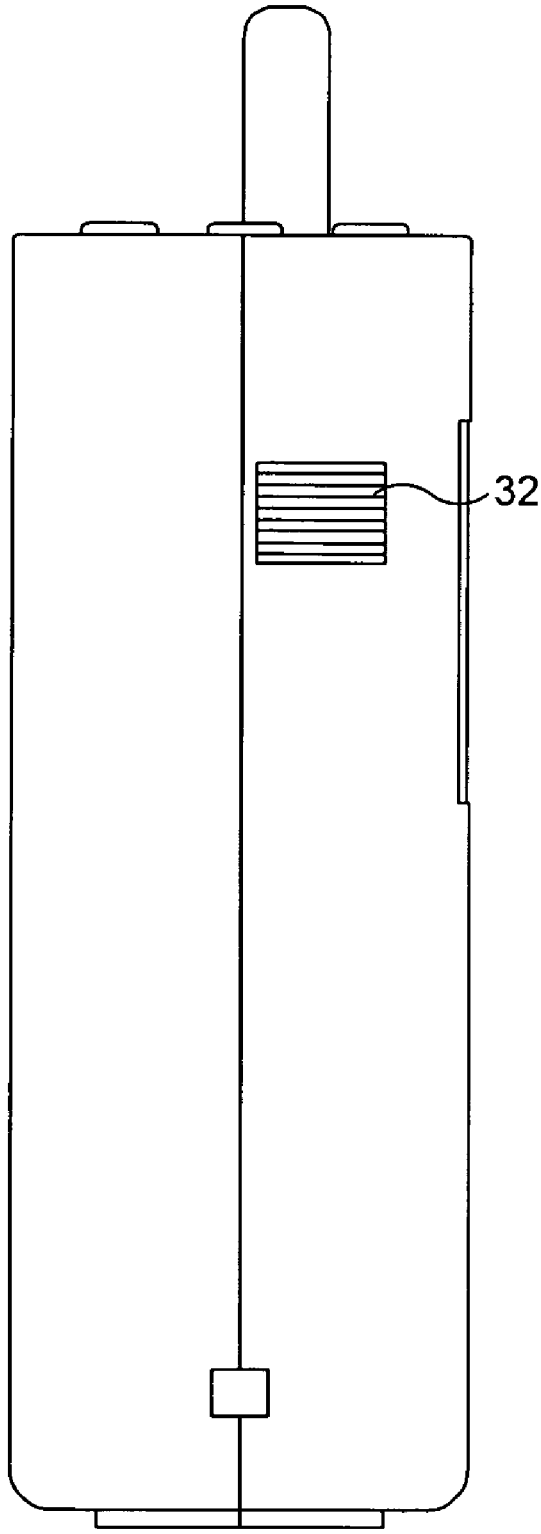
FIG. 4 is another side elevation view of the product depicted in FIG. 1.
Figure 5:
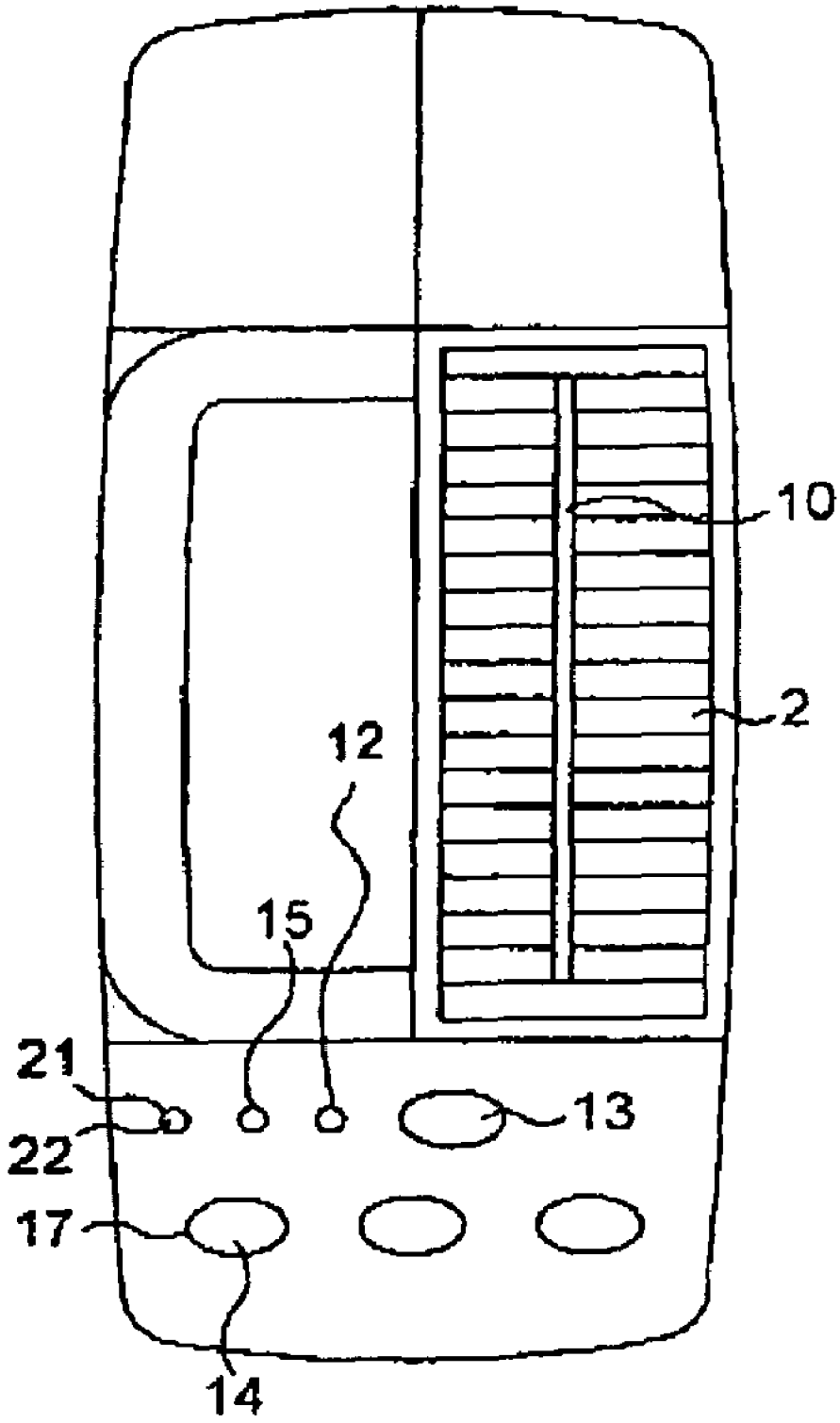
FIG. 5 is an upward view of the product depicted in FIG. 1.
Figure 6:
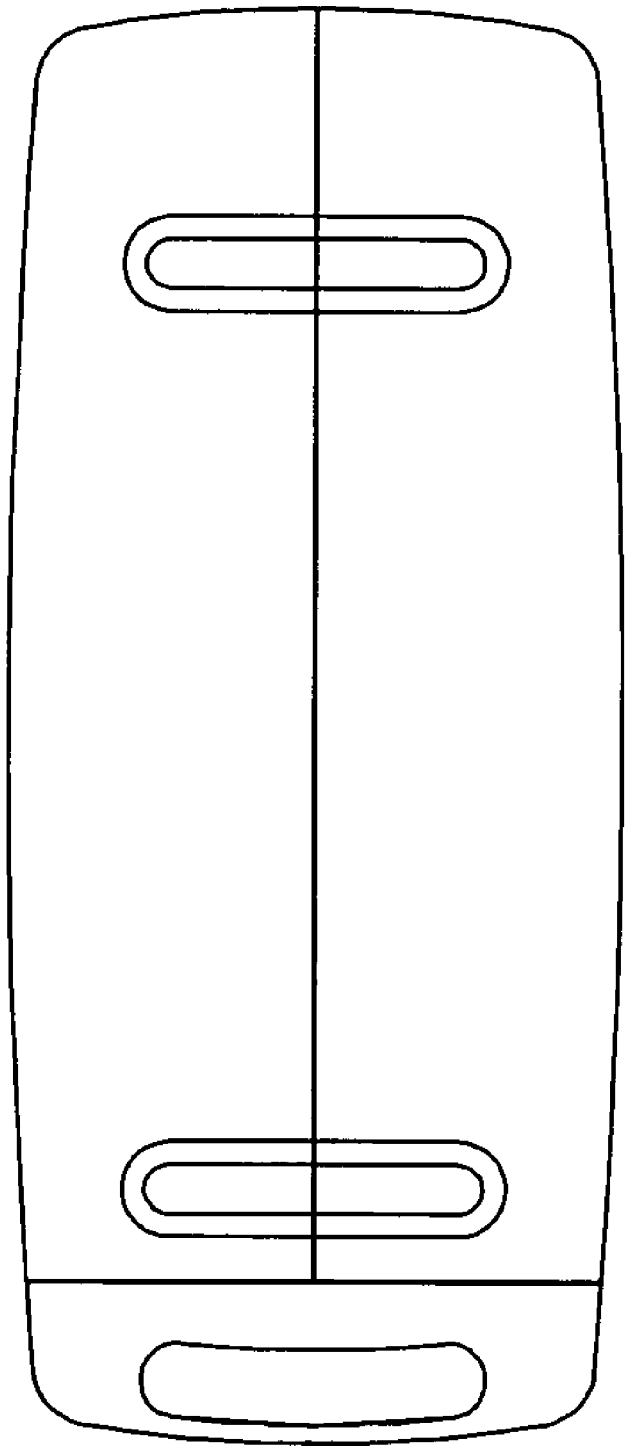
FIG. 6 is a downward view of the product depicted in FIG. 1.
Figure 7:
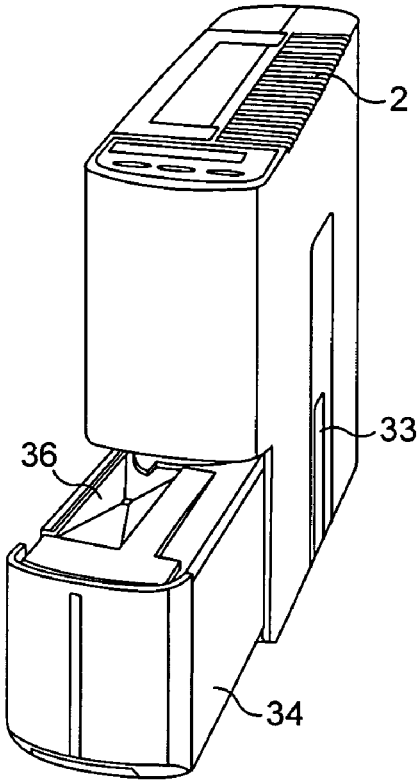
FIG. 7 is a three-dimensional view of the product depicted in FIG. 1.
Figure 7:
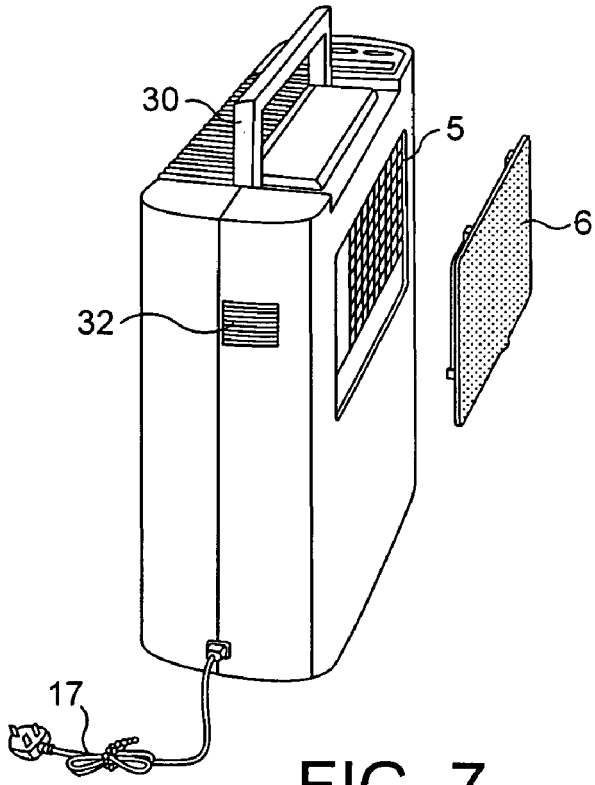

The system has a square-column-shaped housing divided into two compartments, the front 1 and the rear 4. Located on the upper back of the front compartment 1 is an air outlet unit 2. Below air outlet unit 2 is a filter frame 3. Ionised air is discharged over air outlet unit 2. There is a water measuring device 33 on the surface of the front compartment 1 which shows how much water is in the water tank 34. At the top of water tank 34 there is a cover 35. On the surface of cover 35 is a water inlet hole 36 which is conveniently placed on the dehumidifier housing 9 to collect moisture which has been extracted by the operation of the dehumidifier.

Figure 8:
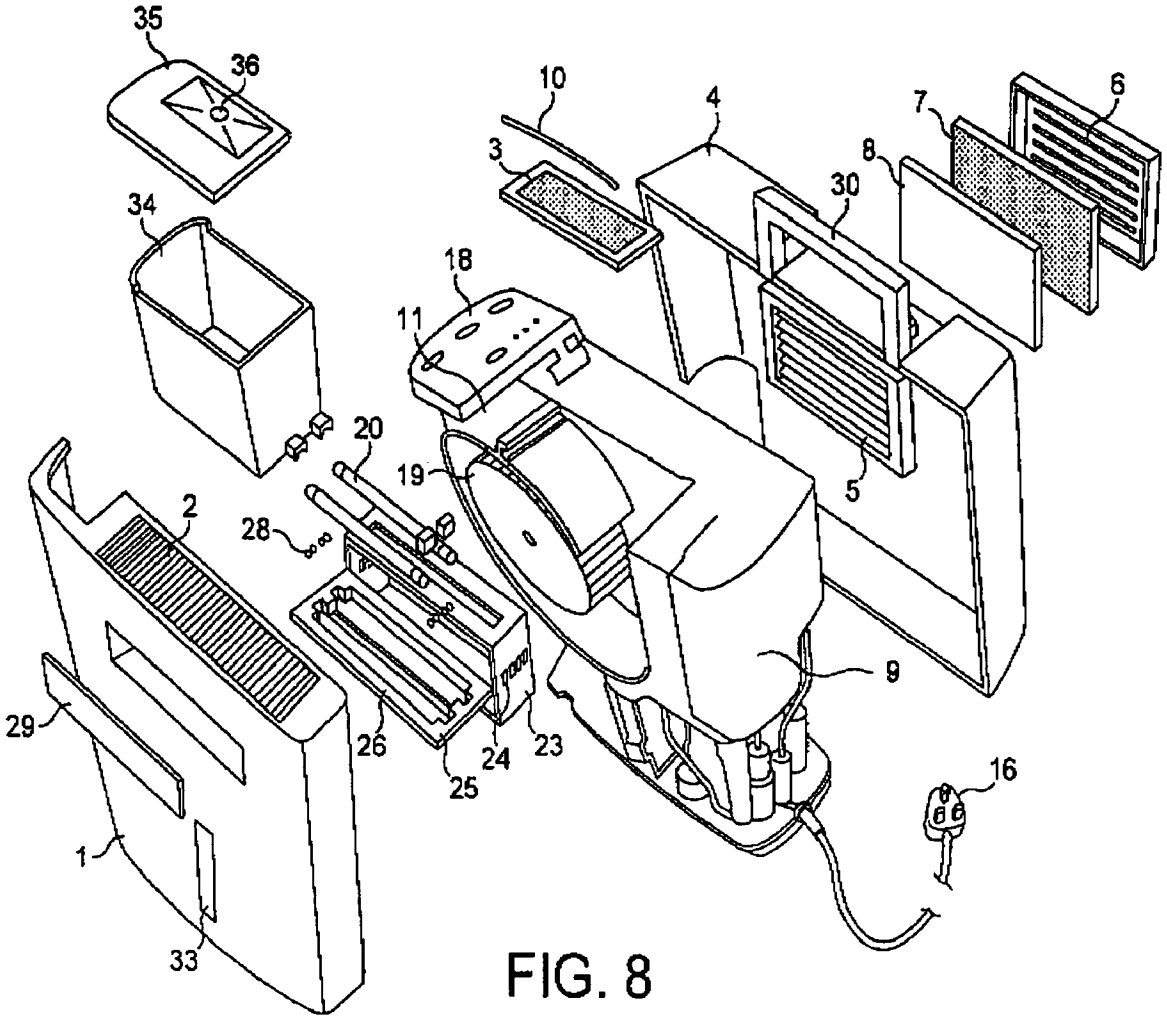
FIG. 8 is an exploded schematic diagram of the product described in FIG. 1.
Figure 9:
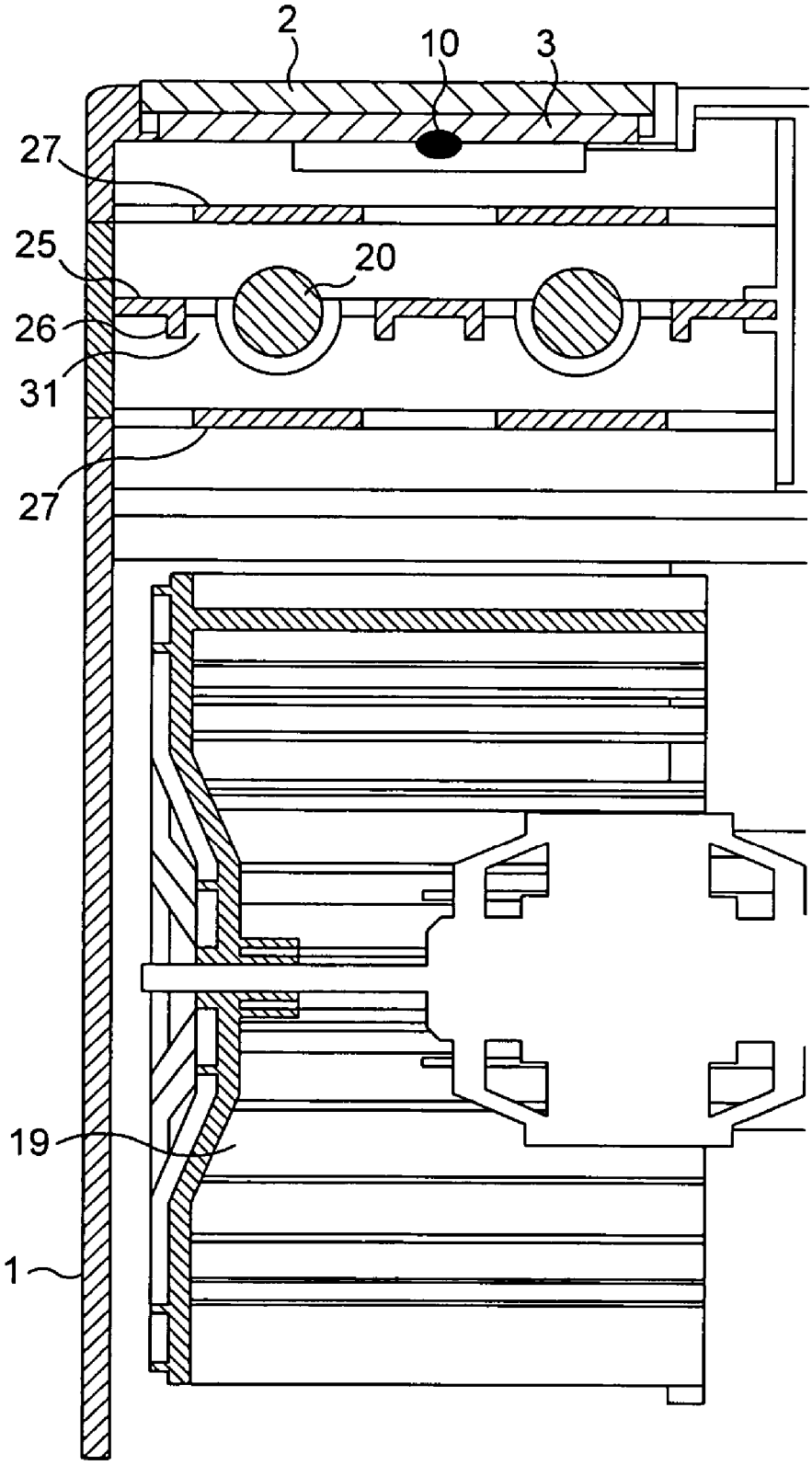
FIG. 9 is a structural plan of the product described in FIG. 1. This plan acts as a description of the extreme-UV light tube module.

FIG. 8 shows a detailed diagram of the 4-in-1 photo-electronic air conditioning, dehumidifying, purifying and disinfecting system. An air inlet unit 5 is situated at the upper front of the rear compartment 4. The air inlet unit 5 consists of an air inlet and activated carbon filter frame 6. On the activated carbon filter frame 6 there is an activated carbon filter 7. A foam rubber dust filter 8 is mounted at the rear of activated carbon filter 7. On the inner surface of the air inlet unit 5, there are extreme-UV light tube module recesses. The extreme-UV light module recesses have four metallic contacts 24, through which electricity is supplied to the extreme-UV light modules 25. The extreme-UV light modules 25 comprise air arresting units 26, light shields 27 at the front and rear, extreme-UV light tubes 20, metallic contacts 24 and a metallic contact accessory box 28. The carbonized fibre 10, secured in the middle of the front surface of air outlet unit 2, ionises the air.

At the inner top of the dehumidifier housing 9 there is an electric generator and electronic transducer 11, a function indicator light 12, a function selector switch 13, a timer 14 and a timer indicator light 15. At the inner bottom of front housing 1 there is a power cord 16.

On the surface of the top of the dehumidifier housing 9 there are several holes 17, and a switch shelving unit 18 where the function switch 13 is mounted. Function switch 13 controls the function of the dehumidifier housing 9, air drum 19, extreme-UV light tubes 20 and a carbonized fibre 10. On the plane surface next to function switch 13, there are several circular holes 21 with different coloured light-emitting diodes 22 acting as function indicators. At the upper rear of the dehumidifier housing 9 is a moisture level regulator 32 which acts as an automatic regulator of air moisture extraction.

At the top of rear compartment 4 there is a hand hold 30. This hand hold 30 enables the 4-in-1 photo-electronic air conditioning, dehumidifying, purifying and disinfecting system to be easily carried.

At the bottom of air inlet unit 6 in the front section of rear compartment 4, there is a catch 31. When the catch 31 is pressed, the activated carbon filter frame 6 automatically separates from the air inlet unit 6, enabling the easy changing of the activated carbon filter 7 and cleaning of rubber dust filter 8. The extreme-UV light tube module 25 can also be taken out, enabling the convenient replacement of extreme-UV light tubes 20.

During operation, the air drum 19 draws air containing germs, bacteria and mould through the activated carbon filter 7 into the extreme-UV light tube module recesses 23. The -extreme-UV light tube module 25 in the extreme-UV light tube module recesses 23 enables air to stream through the air-arresting units 26 before reaching the air outlet 2. The extreme-UV light tubes 20 are mounted in the centre of the air-arresting units 26. When air containing germs, bacteria and mould moves through the air arresting units 26, on reaching the air portals 31 by passing between the extreme UV light tubes 20 and air-arresting units 26, extreme-UV light emitted from extreme-UV light tubes 20 eliminates germs, bacteria and mould from the air. The purified air is then drawn into the dehumidifier housing 9 by the air drum 19. The air is then ionised by the cathodic high-voltage carbonized fibre 10 of the air outlet unit 2. The clean, fresh air is then discharged from the air outlet unit 2. This can further improve the quality of air indoors.

There are light shields 27 mounted over the front and rear of air-arresting units 26 to prevent users from being dazzled by any possible leakage of extreme-UV light from the front compartment 1.

The principles of the electrical circuits of the system are: the power supply input reaches the anion producing circuitry via the function selector switch 13, providing a negative high-voltage output. The power supply input also passes through a full wave rectifier circuit to supply power to a speed control circuit, which supplies the air drum 19, then passes through a DC to AC conversion circuit, to run the full wave rectifier extreme-UV light tubes 20 circuit; another circuit passes a DC voltage stabilizing circuit to reach the ioniser circuit and supplies power to the automatic cycle control circuit of the extreme-UV light tubes 20 activation circuit, controlling the alternating operation of the ioniser and the extreme-UV light tubes 20.

The extreme-UV light tubes emit ultraviolet light at the wavelength of 253.7 nanometres, which has been proven by scientific research to be most effective in eliminating air-borne bacteria, germs and mould in the air. An increased level of anions in the air caused by the anion generator helps boost the biochemical reactions in our body and reduces hormonal secretions held responsible for depression and fatigue. The invention therefore serves well in most households, hospitals, residential homes, department stores, cinemas, restaurants, offices and workshops as well as lifts, vehicles, ships, airplanes and trains. This 4-in-1 photo-electronic air conditioning, dehumidifying, purifying and disinfecting system will improve the environment in our homes, hospitals, offices, shops and transportation. It also helps to revitalise air quality amidst the constant degradation of our natural environment.

The invention claimed is:

1. A photo-electronic air conditioning, dehumidifying, purifying and disinfecting system comprising a housing containing an air drum, an electric motor for driving the air drum to produce an airflow, one or more extreme-UV light tubes, one or more air-arresting units, a power supply cable, a dehumidifier, a cathodic high-voltage carbonized fibre and an activated carbon filter, wherein the one or more air-arresting units concentrates or deflects the airflow into a slot containing a respective one of the one or more extreme-UV light tubes.

2. The system according to claim 1, wherein the housing has a generally square-column shape.

3. The system according to claim 1, wherein the housing also contains a transformer, an electrical circuit board, a function switch and indicator lights.

4. The system according to claim 1, wherein the air arresting unit has a front and a rear light shield, which prevent extreme-UV light from escaping from the housing, thus protecting the user's eyes.

5. The system according to claim 1, wherein the one or more extreme-UV light tubes are removable and may be replaced.

6. The system according to claim 1, wherein the activated carbon filter is removable and may be replaced.

7. The system according to claim 1, wherein the housing has a hand hold for the easy carriage of the system.

8. The system according to claim 1, including multiple said extreme-UV light tubes, wherein the air arresting units concentrate or deflect the airflow into respective said slots each containing one of said extreme-UV light tubes.

9. An electrical circuit system that is capable of improving specific characteristics of the environment, specifically for use in purifying indoor air and increasing the level of anions contained in the air, wherein the electrical circuit system includes:

a negative ion generating circuit for a cathodic high-voltage carbonized fibre;

a circuit which enables the emission of UV light at the wavelength of 253.7 nm from one or more extreme-UV light tubes; and a circuit which enables air conditioning and dehumidifying;

wherein the electrical circuit system has first and second modes, the first involving cathodic high-voltage output discharged via the cathodic high-voltage carbonized fibre, the ionized air containing the anions then being expelled by an air drum; the second involving the elimination of bacteria, germs and mould from air as it passes the one or more extreme-UV light tubes by exposure to extreme-UV light emitted by the one or more extreme-UV light tubes, and the electrical circuit system in addition allows a user to choose to operate in the first mode or in the second mode separately or to choose continuous simultaneous operation or to choose operation of the two modes in a continuous alternating cycle.

10. The electrical circuit system according to claim 9, wherein the cathodic high-voltage output is within the range of 4.5 kV to 8.5 kV.

* * * * *